US005215847A

United States Patent [19]

Patel et al.

[11] Patent Number: 5,215,847

[45] Date of Patent: Jun. 1, 1993

[54] PROCESS FOR OBTAINING IMPROVED DISPERSION OF COMPONENTS IN TONER PARTICLES

[75] Inventors: Raj Patel, Oakville; Hadi K. Mahabadi, Etobicoke; Terry L. Bluhm, Oakville; Sandra J. Gardner, North York, all of Canada

[73] Assignee: Xerox Corporation, Stamford, Conn.

[21] Appl. No.: 753,544

[22] Filed: Sep. 3, 1991

[51] Int. Cl.[5] ..... G03G 9/83

[52] U.S. Cl. ..... 430/106.6; 430/137

[58] Field of Search ..... 430/106.6, 110, 137

[56] References Cited

U.S. PATENT DOCUMENTS

| | | | |
|---|---|---|---|
| 4,148,741 | 4/1979 | Bayley | 252/62.1 |
| 4,293,632 | 10/1981 | Dickerson et al. | 430/137 |
| 4,307,169 | 12/1981 | Matkan | 430/138 |
| 4,727,011 | 2/1988 | Mahabadi et al. | 430/138 |
| 4,789,617 | 12/1988 | Arahara et al. | 430/137 |
| 4,971,882 | 11/1990 | Jugle | 430/110 |
| 5,080,994 | 1/1992 | Breton et al. | 430/137 |

*Primary Examiner*—John Goodrow
*Attorney, Agent, or Firm*—Oliff & Berridge

[57] ABSTRACT

Toner with well-dispersed component subparticles is prepared by a method wherein an attritor is initially used to disperse the subparticles in a core monomer, and attrition is continued during initial polymerization of the monomer. Interfacial polymerization is then performed in a preferred embodiment to form encapsulated toner particles.

21 Claims, No Drawings

PROCESS FOR OBTAINING IMPROVED DISPERSION OF COMPONENTS IN TONER PARTICLES

This invention is directed to a process for preparing toner particles with a good dispersion of toner components within the particles.

BACKGROUND OF INVENTION

In conventional toner preparation by extrusion, toner components are mixed in an extruder. The toner material is then extruded through a die, pelletized, subjected to jetting to reduce the size of the particles, and classified. This method forms particles in which the components are evenly dispersed, but requires many separate steps which may take considerable time and involve substantial cost.

Methods of preparing encapsulated toner in situ are known in the art, such as that process described in U.S. Pat. No. 4,727,011 to Mahabadi et al. Generally, a process of preparing an encapsulated toner in situ comprises the steps of (1) forming a mixture of core monomer, free-radical chemical initiator, pigment and a first shell monomer; (2) forming a stabilized aqueous suspension comprising droplets of the mixture; (3) subjecting this suspension to an interfacial polymerization by the addition of a water-soluble second shell monomer; and (4) initiating a free radical polymerization of the core after the interfacial polymerization is complete by increasing the temperature of the suspension, thus commencing the disassociation of the chemical initiator to free-radicals capable of polymerizing the core monomers, thereby forming encapsulated toner particles.

U.S. Pat. No. 4,307,169 to Matkan discloses electroscopic marking particles comprising microcapsules having a pressure-fixable core and pressure-rupturable shell. The process of preparing these particles involves constant agitation to produce microdroplets of a non-aqueous ink phase encapsulated in a shell which is formed by interfacial polycondensation in an aqueous dispersion of reactants on and about the core. An attritor may be used to produce the ink phase.

In situ methods of preparing non-encapsulated toners are also known. U.S. Pat. No. 4,789,617 to Arahara et al. discloses a process of producing toners comprising the steps of: (1) dispersing a monomer/colorant composition in an aqueous medium at high temperature to form "particles" of the monomer composition; (2) adjusting the aqueous medium to the polymerization temperature; and (3) adding a water-insoluble polymerization initiator to the aqueous medium containing the monomer composition dispersed therein to effect polymerization. According to the examples, an attritor may be used to prepare the monomer composition before addition of the polymerization initiator.

U.S. Pat. No. 4,148,741 to Bayley discloses a method for preparing toners by direct polymerization of polymers. The method comprises the steps of: (1) dispersing in an aqueous medium a monomer having dispersed therein a pigment; (2) agitating the pigmented monomer particles in a reactor to cause a polymerization reaction to form polymerized beads; (3) separating the polymerized beads from the water; and (4) attriting the beads to form toner particles. An initiator or catalyst which is compatible with the monomer may be used in the method.

U.S. Pat. No. 4,293,632 to Dickerson et al. discloses a process for treatment of certain toner materials. An attrition process is used to remove a small portion of a surface of the toner while exposing an underlying inner portion at the same time.

In in situ toner preparation processes, prior to the step of preparing the stabilized aqueous suspension, generally subparticles such as pigment, magnetic material or the like are mixed with the monomer and dispersed therein before droplets of the monomer mixture are formed in an aqueous suspension. However, good dispersion of the subparticles has been a continuing problem, because the subparticles tend to migrate to the monomer-water interface. After the encapsulation process is completed, the subparticles may predominantly be found either at the shell-core interface or even within the shell. Thus, while this process requires fewer steps and thus less time and cost than conventional extrusion methods, there is the inherent problem of forming resin in which the particles are not homogeneously dispersed. Good pigment dispersion is particularly critical in very small toner particles and to provide toner with high projection efficiency in transparencies.

One method of dealing with the problem of providing good pigment dispersion is to use "flushed pigments", wherein a pigment is flushed into a polymeric resin used to prepare the encapsulated toner. Flushed pigments are very expensive, however, and are only available with a limited number of copolymers. The technology for their production is proprietary. Flushed polymers generally contain a high concentration of pigment, and it is generally necessary to "dilute" them with further polymer. However, it is not convenient even in this circumstance to use a different polymer as a "diluent". It is desirable to prepare toners having cores which are not composed of these specific copolymers. Phase separation of the core polymers and flushed pigment is often observed because of the incompatibility of the core polymer and the flushing polymer.

Therefore, polymers which do not require compatibility with specific flushed pigments, which will provide good pigment dispersion and thereby provide the advantages of flushed pigment are desirable.

SUMMARY OF THE INVENTION

It is an object of the invention to provide a toner with good dispersion of component "subparticles" at low cost.

It is another object of the invention to provide a toner which eliminates the need for flushed pigment.

It is a further object of the invention to provide a toner wherein the component subparticles can be dispersed in situ in a manner that they are less prone to migrate out of the core.

It is still a further object of the invention to provide a toner with high projection efficiency for use in transparencies.

It is yet another object of the invention to provide a process for preparing the aforementioned toners.

These and other objects are accomplished by a process for preparing toner particles wherein a mixture comprising a toner monomer and toner component subparticles such as pigments and/or magnetic materials is subjected to attrition. The attrition is preferably continued while the monomer is partially polymerized to form a homogeneous mixture of polymer and toner component subparticles. This mixture may then be used in conventional methods of preparing toner, particularly encapsulated toner, by a suspension process.

DETAILED DESCRIPTION OF PREFERRED EMBODIMENTS

This invention provides a process for preparing toner particles wherein particles of a toner component are mixed with liquid monomer to form a mixture which is subjected to attrition and polymerization until the monomer is partially polymerized. (The particles of the component are hereinafter termed "subparticles" because they are small particles within the larger toner particles). This process can be used to form a homogeneous stable mixture which can then be subjected to suspension polymerization to form fine toner particles. A device which finely grinds, e.g., pigment and monomer, preferably an attritor, is used to disperse the toner component in the core monomer and to partially polymerize the monomer prior to formation of a suspension of the monomer in an aqueous phase. As used herein, the term "suspension" refers to a suspension of particles and/or droplets in a suspending medium in which the particles and/or droplets are substantially insoluble. The toner component may be any toner component which is insoluble in the monomer, preferably a pigment and/or a magnetic material. In a preferred embodiment, an aggregate of the toner component is subjected to the attrition in the presence or absence of the liquid monomer before the partial polymerization during attrition is carried out. Optionally, but less desirably, the attrition may be performed after partial polymerization, although this adds an additional step.

The process of a preferred embodiment of the invention may employ a process for preparing an encapsulated toner similar to that disclosed in U.S. Pat. No. 4,727,011, which is hereby incorporated by reference. More specifically, the process may include the steps of initially attriting an aggregate of the component to form particles of a predetermined size; forming an organic phase by mixing a blend of a core monomer or monomers, one or more polymerization initiators (preferably free radical polymerization initiators), the component, and an oil-soluble shell precursor or precursors; subjecting the aforementioned organic phase to attrition in order to effect a homogeneous dispersion of the component throughout the organic phase; continuing attrition while partially polymerizing the monomer(s); adding an aqueous solution of suitable dispersants or suspension agents; subjecting the product to blending to form a suspension of the organic phase in an aqueous phase; subjecting the suspension to interfacial polymerization with addition of a water soluble second shell monomer, preferably at about room temperature, to form a core of the organic phase within an encapsulating shell polymer; increasing the temperature of the reaction medium, thereby effecting further polymerization (preferably free radical polymerization) of the core monomer(s) within the encapsulated core; thus resulting in a toner composition comprising a polYmeric core containing well-dispersed component subparticles encapsulated by a polymeric shell.

In a preferred embodiment, the oil-soluble shell precursor(s) is/are not added to the organic phase until after the partial polymerization to avoid undesirable reactions. Also, initial attrition of the component/core monomer(s) mixture can be performed for some time prior to addition of polymerization initiator(s).

In the process of the invention wherein the subject component is a pigment, pigment aggregates are initially subjected to attrition to form subparticles of the desired size, ranging from 0.1 to 1.0, and preferably 0 03 to 0.2 $\mu$ or 0.3 $\mu$, depending on the pigment. These subparticles are then mixed with liquid monomer, and optionally with initiator. By careful selection of reactants, it is possible for all the reactants to be blended in the initial mixture, thus enabling a simple process. Other combinations of reactants, however, may require that the initiator and other reactants, such as shell monomers, be added in a step-wise manner. The monomer/-component mixture is initially mixed in an attritor. The attrition is performed for 0 to 16 hours and is performed at a temperature of 10° to 70° C. If a chemical initiator has not been included in the initial mixture, it is then added to the monomer mixture, and attrition is continued until an intimate mixture of polymer and component forms, which intimate mixture has high homogeneity of the components dispersed in the polymer, similar to the homogeneity found in a flushed pigment. This attrition is preferably performed for 0 to 16 hours and at a temperature of 10° to 70° C. The aqueous phase of the mixture is formed after these initial attrition steps are performed. The resulting mixture is then used as the core which is dispersed in the aqueous phase, after which interfacial polymerization is effected.

In the attrition polYmerization process, it is critical to control the viscosity of the mixture. If the mixture becomes too viscous, the attrition process cannot continue without damaging the attritor; if the mixture remains too fluid, the component subparticles will tend to migrate and will not be homogeneously distributed throughout the resultant toner particles. One method of controlling the viscosity of the mixture is to control the molecular weight of the polymer formed by the attrition. This is accomplished by controlling the duration and temperature of the attrition process, and by careful selection of the monomers employed in the process. For example, in a system comprising Vazo 52 as an initiator and styrene/n-butyl methacrylate as the polymerizable monomers, the preferred polymerization temperature is 60° C for a maximum of 2 hours (i.e., just enough to increase the viscosity). Additionally, other combinations of initiator, polymerization temperature, and length of time may be employed to increase the core monomer viscosity.

Materials used in this process may include the following:

A. Colorants and Magnetic Materials

Colorants and/or magnetic materials used organic phase may include most known pigments, dyes, and magnetic materials, including Carbon Black, Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Heliogen Green, Phthalocyanine Blue, Cobalt Blue, Cinquassi Green, Hostaperm Green, Titanium Dioxide, Cobalt, Nickel, Iron Powder, Sicopur 4068 FF, and Iron Oxides such as Mapico Black (Columbia), NP608 and NP604 (Northern Pigment), Bayferrox 8610 (Bayer), M08699 (Mobay), TMB-100 (Magnox), mixtures thereof and the like.

The colorant and/or magnetic material is incorporated in an amount sufficient to impart the desired color and/or magnetic properties to the toner. In general, colored pigment is employed in an amount ranging from about 0 to 10 percent by weight, and preferably from about 2 to 7 percent by weight, of toner. For magnetic toner, the magnetic material is utilized in an effective amount from about 10 to about 70 percent by weight, and preferably from about 40 to about 60 percent by weight.

B. Toner Monomers

The process of the invention enables a wide choice of monomers for preparing the toner of the invention, because there is no need to be concerned with the compatibility of the toner monomer or polymer and the polymer of a flushing pigment in order to insure that polymeric phase separation does not occur.

Typical toner monomers include, but are not limited to, addition-type monomers such as methyl acrylate, methyl methacrylate, ethyl acrylate, ethyl methacrylate, propyl acrylate, propyl methacrylate, butyl acrylate, butyl methacrylate, iso-butyl methacrylate, pentyl acrylate, pentyl methacrylate, hexyl acrylate, hexyl methacrylate, heptyl acrylate, heptyl meth-acrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, and other substantially equivalent addition monomers such as methyl vinyl ether, maleic anhydride, and other known vinyl monomers and the like. These monomers may be present alone or as mixtures of monomers to form copolymers. The monomers may also be present in conjunction with preformed polymers so that subsequent polymerization of the core monomer results in a polymer blend, which may be either a compatible blend, wherein the polymers are miscible and form a uniform, homogeneous mixture, or an incompatible blend, wherein one polymer is present in discrete regions or domains within the other polymer.

Preformed polymers may be included as a component of the toner. These polymers are preferably compatible with and readily soluble in the toner monomers. Examples of suitable polymers include polymers of the monomers listed above as suitable monomers, as well as copolymers of these monomers, such as styrene-butadiene copolymers, styrene-acrylate and styrene-methacrylate copolymers, ethylene-vinylacetate cOpOlymers, isobutylene-isoprene copolymers, and the like.

The monomer is generally employed in an amount from about 10 to about 90 percent by weight, preferably from about 20 to about 90 percent by weight, of the toner. If preformed binder is added, the amount of monomer that is employed for the binder-forming polymerization is then reduced accordingly.

In a preferred embodiment, the above toner monomers are used to form the cores of encapsulated toner particles, and may be conveniently referred to as core monomers.

C. Free Radical Initiators

Any suitable free radical initiator may be employed to polymerize the toner monomer. If an encapsulated toner is to be prepared by a free radical polymerization of a core monomer subsequent to an interfacial polymerization reaction that forms a toner shell, the 10 hour half-life temperature of the initiator should be less than about 120° C, preferably less than about 90° C. Suitable free radical initiators include azo type initiators, such as 2,2'-azobis(isobutyronitrile), 30 2,2'-azobis(2,4-dimethylvaleronitrile), 2,2'-azobis(cyclohexanenitrile), 2,2'-azobis-(2-methylbutyronitrile), 2,2'-azobis(2,2'-azobis(2,4-dimethyl-4-methoxyvaleronitrile)) or initiators also include peroxide type initiators such as benzoyl peroxide, lauroyl peroxide and 2,5-dimethyl-2,5-bis(2-ethylhexanoylperoxy)hexane, Lupersol 256® (Pennwalt), or any combination thereof.

Typically, a low temperature reacting initiator is present in the toner monomer(s), being activated at temperatures of from about 40° C. to about 65° C. The low temperature initiator is generally present in an amount of from about 0.5 to about 6 percent by weight of the toner monomer(s), and preferably from about 2 to about 4 percent by weight of the toner monomer(s). Optionally, a high temperature initiator may also be present in the toner monomer(s), being activated at temperatures over 60° C. The high temperature initiator may be present in amounts of from 0 to about 2 percent by weight of the toner monomer(s), and preferably from about 0.5 to about 1.25 percent by weight of the toner monomer(s).

D. Shell Materials

When forming an encapsulating shell, one or more organic phase shell monomers can be used to react with one or more aqueous phase shell monomers. Although formation of the shell entails reaction between at least two shell monomers, one from the organic phase and one from the aqueous phase, as many as five or more monomers soluble in organic phase and as many as five or more monomers soluble in aqueous phase can be reacted to form the shell. In some preferred instances, up to two monomers soluble in organic phase and up to two monomers soluble in aqueous phase can be reacted to form the shell.

Shell polymers suitable for use in the present invention include those which may be formed in an interfacial polymerization process. Typical shell polymers include polyureas, polyurethanes, polyesters, thermotropic liquid crystalline polyesters, polycarbonates, polyamides, polysulfones, and the like, or mixtures of these polymers such as poly(urea-urethanes), poly(ester-amides), and the like.

The organic soluble shell monomers include benzene diisocyanate, toluene diisocyanate, diphenylmethane diisocyanate, trans-1,4-cyclohexane diisocyanate, hexamethylene diisocyanate (Fluka), dodecane diisocyanate (Dupont), 2-methylpentyldiisocyanate (Dupont), dicyclohexylmethane diisocyanate (Desmodur w, available from Mobay), Isonate 143L (liquid MDI based on 4,4-methyldiphenyl diisocyanate, available from the Upjohn Co.), tris(isocyanatophenyl) thiophosphate (Desmodur RF, available from Mobay), 3,3,5-trimethylhexamethylenediisocyante (Huls), MONDUR CB-60 (Mobay), MONDUR CB-75, MONDUR MR, MONDUR MRS 10, PAPI 27, PAPI 135, PAPI 94, PAPI 901 (Mobay), Isonate 143L (Upjohn Chem. Co.), Isonate 181, Isonate 125M, Isonate 191, and Isonate 240, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. Other oil soluble shell monomers include polyether diisocyanate prepolymers such as Desmodur M (Mobay), Desmodur E-21 (Mobay), Vibrathane B-602 (Uniroyal), Vibrathane B-603 (Uniroyal), Vibrathane B-604 (Uniroyal), polyester prepolymer diisocyanates such as Adiprene L-83 (Uniroyal), Adiprene L-167 (Uniroyal), Adiprene L-252 (Uniroyal), (Uniroyal), Vibrathane 8021 (Uniroyal), Vibrathane 6007 (Uniroyal), mixtures thereof and the like.

The shell monomer present in the organic phase is generally present from about 5 to about 25 percent by weight, preferably from about 10 to about 20 percent by weight, of the toner composition.

The shell monomers in the aqueous phase include ethylene diamine, triethylene diamine, 1,3-diaminopropane, 1,4-diaminobutane, 1,5-diaminopentane, 1,6-diaminohexane, Dytek A (Dupont), bis-(3-aminopropyl) piperazine, 2,5-dimethylpiperazine, 2-methylpiperazine, 3,3,5-trimethylhexamethylenediamine, ethylene glycol, butylene glycol, isopropylene glycol, and prepolymer diamines such as Jeffamine D-240 (Texaco), Jeffamine D-400, Jeffamine D-600, Jeffamine ED-900, mixtures thereof and the like. The shell monomer present in the aqueous phase is generally present from about 5 to about 25 percent by weight, preferably from about 10 to about 20 percent by weight of the aqueous phase.

E. Surfactants

A surfactant or emulsifier is generally added to disperse the particles/droplets formed in the organic phase in the aqueous medium and for stabilization of these particles/droplets against coalescence or agglomeration prior to shell formation and encapsulation of the core. Many types of surfactants can be employed, such as polyvinyl alcohol, polyethylene sulfonic acid salt, polyvinylsulfate ester salt, carboxylated polyvinyl alcohol, water soluble alkoxylated diamines or similar water soluble block copolymers, gum arabic, polyacrylic acid salt, carboxy-methylcellulose, hydroxypropylcellulose, hydroxyethylcellulose, Tylose (Fluka), Methocel (Dow Chemical), quaternary amine functionalized cellulose derivatives, block copolymers of propylene oxide and ethylene oxide, gelatin, phthalated gelatin, and succinated gelatin salts of alginic acid. In addition, water soluble inorganic salts may also be employed to stabilize the dispersion, such as trisodium polyphosphate, tricalcium polyphosphate, and the like.

Preferably, any surface-active agent is added in water in a concentration lower than the critical micelle concentration, generally in a concentration of 50 to 100% of the critical micelle concentration. When a surfaceactive inorganic powder is used, the concentration of the inorganic powder in the aqueous medium is desirably 0.01 to 50% by weight, preferably 0.1 to 10% by weight, of the aqueous medium.

The invention will further be illustrated in the following, non-limiting examples, it being understood that these examples are intended to be illustrative only and that the invention is not intended to be limited to the materials, conditions, process parameters and the like recited herein.

EXAMPLE I

To prepare red encapsulated toner particles, 7 g of Lithol Scarlet (#4300), 125.4 g of styrene and 67.6 g of stearyl methacrylate (SMA) are charged into an attritor. To this mixture, 7.56 g of Vazo 52 initiator is added. Steel shots are added to the mixture and the contents are attrited for 2 hours at room temperature. The contents are then transferred to a beaker to which 2.85 g of Vazo 67 initiator, 2.74 g of Vazo 88 initiator and 31.7 g of m-tetra methyl xylene diisocyanate (TMXDI) are added and the mixture is subjected to a polytron at 4000 rpm to dissolve the initiators. After the addition of 500 g of Tylose (0.75%) aqueous solution, the mixture is again subjected to a polytron for 2 minutes at 10,000 rpm to form particles. The contents of the beaker are then transferred to a two liter reaction vessel and stirred at 1000 rpm. A solution of Dytek A (18.4 g) and water (80 g) is added to the reaction vessel to initiate interfacial polymerization and encapsulate the particles. After ½ hour of stirring at room temperature, the temperature of the mixture is elevated to initiate freeradical polymerization. A four step free-radical polymerization temperature profile consisting of, in sequence, 2 hours at 60° C., ½ hour at 75° C., 1½ hours at 85° C., and 3 hours at 93° C. is employed, after which the contents of the reaction vessel are cooled, filtered and washed several times before freeze drying. The resulting red colored particles have average diameters of 12 microns and a GSD of 1.40.

EXAMPLE II

To prepare red encapsulated toner particles, 7 g of Lithol Scarlet (#4300), 125.4 g of styrene and 67.6 g of stearyl methacrylate (SMA) are charged into an attritor. To this mixture 3.00 g of Vazo 52 initiator is added and the temperature is raised to 43° C. to initiate bulk polymerization. Steel shots are added to the mixture and the contents are attrited for 1 to 1½ hours. The polymer/monomer mixture is then transferred to a beaker to which 2.93 g of Vazo 52 initiator, 2.85 g of Vazo 67 initiator, 2.74 g of Vazo 88 initiator and 31.7 g of m-tetra methyl xylene diisocyanate (TMXDI) are added and the mixture is subjected to a polytron at 4000 rpm to dissolve the initiators. After the addition of 500 g of Tylose (0.75%) aqueous solution, the mixture is subjected to a polytron for 2 minutes at 10,000 rpm to form particles. The contents of the beaker are then transferred to a two liter reaction vessel and stirred at 1000 rpm. A solution of Dytek A (18.4 g) and water (80 g) is added to the reaction vessel to encapsulate the particles. After ½ hour of stirring at room temperature, the temperature of the mixture is elevated to initiate free-radical polymerization. A four step freeradical polymerization temperature profile (as described in Example I) is employed, after which the contents of the reaction vessel are cooled, filtered and washed several times before freeze drying. The resulting red colored particles have an average diameter of 11.8 microns with a GSD of 1.43. cl EXAMPLE III

To prepare yellow encapsulated toner particles, 7.65 g of Sico-Fast Yellow along with 125.4 g of styrene and 67.6 g of SMA are charged into an attritor. To this mixture, 3.00 g of Vazo 52 initiator is added and the temperature is raised to 43° C. to initiate bulk polymerization. Steel shots are added to the mixture and the contents are attrited for 1 to 1½ hours. The polymer/monomer mixture is then transferred to a beaker to which 2.93 g of Vazo 52 initiator, 2.85 g of Vazo 67 initiator, 2.74 g of Vazo 88 initiator and 31.7 g of m-tetra methyl xylene diisocyanate (TMXDI) are added and subjected to a polytron at 4000 rpm to dissolve the initiators. After the addition of 500 g of Tylose (0.75%) aqueous solution, the mixture is subjected to a polytron for 2 minutes at 10,000 rpm to form particles. The contents of the beaker are then transferred to a two liter reaction vessel and stirred at 1000 rpm. A solution of Dytek A (18.4 g) and water (80 g) is added to the reaction vessel to encapsulate the particles. After ½ hour of stirring at room temperature, the temperature of the mixture is elevated to initiate free-radical polymerization. A four step free-radical polymerization temperature profile (as described in Example I) is employed, after which the contents of the reaction vessel are cooled, filtered and washed several times before freeze drying. The resulting yellow colored particles have an average diameter of 11.0 microns and a GSD of 1.48.

EXAMPLE IV

To prepare blue toner particles, a bulk polymerization is conducted with styrene, stearyl methacrylate (SMA), Vazo 52 initiator and Vazo 67 initiator at a temperature of 60° C. for 50 minutes to reach a limited conversion. The resulting partially polymerized copolymer is transferred to an attritor to which 3.2 g of Heliogen Blue pigment is added. This mixture is then attrited for 1 hour at room temperature to disperse the pigment. The mixture is transferred to a beaker and 400 g of 0.75% Tylose is added and subjected to a polytron for 3 minutes at 10,000 rpm. The contents are then transferred to a reaction vessel and free-radical polymerization is carried out. The resulting blue colored particles have an average diameter of 12.8 microns and a GSD of 1.43.

EXAMPLE V

To prepare magenta toner particles, 150 g of styrene, 0.75 g of polyvinyl pyridiene co-styrene (PVPCS), 7.5 g of Hostaperm Pink pigment, 5.85 g of Vazo 52 and 1.50 g of Vazo 67 are added to an attritor. The mixture is then attrited at 50° C. for 1½ hours. The resulting partially polymerized material is removed from the attritor and placed in a vessel equipped with a polytron. To the mixture are added 23.75 g of m-tetra methyl xylene diisocyanate (TMXDI) and the resulting mixture is then subjected to a polytron for 30 seconds at 4000 rpm. 750 g of 0.75% Tylose are then added to the above mixture and the mixture is then subjected to a polytron at 10,000 rpm for 1½ minutes. The contents are then transferred to a two liter reactor to which 13.75 g of Dytek A and 62 g of water are added. After 30 minutes of interfacial polymerization at room temperature, the temperature of the reactor is subsequently raised to 60° C., 75° C. and 85° C. in steps to complete the free-radical polymerization. The resulting magenta colored particles have an average diameter of 14.0 microns and a GSD of 1.50.

EXAMPLE VI

Charged into an attritor are 102.9 g of styrene, 17.1 g of XP707 (styrene/butylmethacrylate copolymer 60% styrene and 40% butylmethacrylate), 0.60 g of polyvinyl pyridiene co-styrene (PVPCS), 6.0 g of Hostaperm Pink pigment, 3.62 g of Vazo 52 initiator and 0.92 g of Vazo 67 initiator. The mixture is then attrited overnight at room temperature. The resulting partially polymerized material is then removed from the attritor and placed in a vessel equipped with a polytron. To this mixture are added 19.0 g of m-tetra methyl xylene diisocyanate (TMXDI); the mixture is then subjected to a polytron at 4000 rpm for 30 seconds. This is followed by the addition of 600 g of 0.75% Tylose in water and the mixture is then subjected to a polytron at 10,000 rpm for 1½ minutes. The contents are then transferred to a two liter reactor to which 11.0 g of Dytek A and 50.0 g of water are added. After 30 minutes of interfacial polymerization at room temperature, the temperature of the reactor is subsequently raised to 60° C., 75° C. and 85° C. in steps to complete the free-radical polymerization. The resulting magenta colored particles have an average diameter of 13.2 microns and a GSD of 1.47.

While the invention has been described with reference to particular preferred embodiments, the invention is not limited to the specific examples given, and other embodiments and modifications can be made by those skilled in the art without departing from the spirit and scope of the invention.

What is claimed is:

1. A process for preparing toner particles, comprising the steps of:

subjecting a first mixture comprising toner monomer and toner component subparticles to attrition;

partially polymerizing said monomer while mixture of said subparticles in said partially polymerized monomer;

forming a suspension of at least one member selected from the group consisting of particles and droplets of said second mixture in a suspension medium; and at least substantially completing polymerization of said monomer.

2. The process of claim 1, wherein said toner component subparticles comprise pigment.

3. The process of claim 1, wherein said toner component subparticles are magnetic.

4. The process of claim 1, wherein said toner monomer and said toner component subparticles are subjected to attrition in the absence of a polymerization initiator for said toner monomer to reduce said subparticles to a predetermined size, and a polymerization initiator is then added to initiate the partial polymerization.

5. The process of claim 1, wherein said suspension is subjected to interfacial polymerization to encapsulate said member.

6. The process of claim 5, wherein said step of at least substantially completing polymerization of said monomer is carried out after said interfacial polymerization.

7. The process of claim 5, wherein said first mixture further comprises a first shell monomer.

8. The process of claim 5, wherein a first shell monomer is added to said second mixture after partially polymerizing said monomer.

9. The process of claim 1, wherein said second mixture has a viscosity of 0.01 to about 100 poise.

10. The process of claim 1, wherein said toner monomer is selected from the group consisting of benzene diisocyanate, toluene diisocyanate, diphenylmethane diisocyanate, trans-1,4-cyclohexane diisocyanate, hexamethylene diisocyanate, dodecane diisocyanate, 2-methylpentyldiisocyanate, dicyclohexylmethane diisocyanate, tris(isocyanatophenyl) thiophosphate, 3,3,5-trimethylhexamethylenediisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, ethylene diamine, triethylene diamine, 1,3-diaminopropane, 1,4-diaminobutane, 1,5-diaminopentane, 1,6-diaminohexane, bis-(3-aminopropyl) piperazine, 2,5-dimethylpiperazine, 2-methylpiperazine, 3,3,5-trimethylhexamethylenediamine, ethylene glycol, butylene glycol, isopropylene glycol, prepolymer diamines, and mixtures thereof.

11. A toner prepared by a process comprising the steps of:

subjecting a first mixture comprising toner monomer and toner component subparticles to attrition;

partially polymerizing said monomer while continuing said attrition to form a stable uniform second mixture of said subparticles in said partially polymerized monomer;

forming a suspension of at least one member selected from the group consisting of particles and droplets of said second mixture in a suspension medium; and at least substantially completing polymerization of said monomer.

12. The toner of claim 11, wherein said toner component subparticles comprise pigment.

13. The toner of claim 11, wherein said toner component subparticles are magnetic.

14. The toner of claim 11, wherein said suspension is subjected to interfacial polymerization to encapsulate said member.

15. The toner of claim 14, wherein said step of at least substantially completing polymerization of said monomer is carried out after said interfacial polymerization.

16. The toner of claim 14, wherein said first mixture further comprises a first shell monomer.

17. The toner of claim 14, wherein a first shell monomer is added to said second mixture after partially polymerizing said monomer.

18. The toner of claim 14, wherein said second mixture has a viscosity of 0.01 to about 100 poise.

19. The toner of claim 14, wherein said toner monomer is selected from the group consisting of benzene diisocyanate, toluene diisocyanate, diphenylmethane diisocyanate, trans-1,4-cyclohexane diisocyanate, hexamethylene diisocyanate, dodecane diisocyanate, 2-methylpentyldiisocyanate, dicyclohexylmethane diisocyanate, tris(isocyanatophenyl) thiophosphate, 3,3,5-trimethylhexamethylenediisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, ethylene diamine, triethylene diamine, 1,3-diaminopropane, 1,4-diaminobutane, 1,5-diaminopentane, 1,6-diaminohexane, bis-(3-aminopropyl) piperazine, 2,5-dimethylpiperazine, 2-methylpiperazine, 3,3,5-trimethylhexamethylenediamine, ethylene glycol, butylene glycol, isopropylene glycol, prepolymer diamines, and mixtures thereof.

20. A process for preparing toner particles, comprising the steps of:

partially polymerizing toner monomer;

subjecting a first mixture comprising said toner monomer and toner component subparticles to attrition to form a stable uniform second mixture of said subparticles in said partially polymerized monomer;

forming a suspension of at least one member selected from the group consisting of particles and droplets of said second mixture in a suspension medium; and at least substantially completing polymerization of said monomer.

21. The process of claim 20 wherein said attrition begins before or during said partial polymerizing step.

* * * * *